US005507884A

United States Patent [19]

Ogino et al.

[11] Patent Number: 5,507,884

[45] Date of Patent: Apr. 16, 1996

[54] PROCESS FOR FORMING A SPARINGLY SOLUBLE CHROMATE COATING ON ZINCIFEROUS METAL COATED STEEL

[75] Inventors: Takao Ogino; Shinji Nomura, both of Kanagawa, Japan

[73] Assignee: Henkel Corporation, Plymouth Meeting, Pa.

[21] Appl. No.: 326,984

[22] Filed: Oct. 21, 1994

[30] Foreign Application Priority Data

Oct. 21, 1993 [JP] Japan ..... 5-263743

[51] Int. Cl.$^6$ ..... C23C 22/30; C23C 22/33

[52] U.S. Cl. ..... 148/258; 148/267

[58] Field of Search ..... 148/258, 267

[56] References Cited

U.S. PATENT DOCUMENTS

| | | | |
|---|---|---|---|
| 4,006,041 | 2/1977 | Brugarolas | 148/258 |
| 4,475,957 | 10/1984 | Sander | 148/258 |
| 4,971,635 | 11/1990 | Guhde | 148/267 |
| 5,366,567 | 11/1991 | Ojino | 148/258 |
| 5,399,209 | 3/1995 | Sudg | 148/258 |

FOREIGN PATENT DOCUMENTS

| | | | |
|---|---|---|---|
| 0105521 | 8/1975 | Japan | 148/267 |
| 52-2851 | 1/1977 | Japan . | |
| 0097541 | 8/1979 | Japan | 148/267 |
| 5822383 | 3/1981 | Japan . | |
| 6283478 | 9/1985 | Japan . | |
| 6396275 | 10/1986 | Japan . | |
| 61-58552 | 12/1986 | Japan . | |

*Primary Examiner*—Sam Silverberg

*Attorney, Agent, or Firm*—Wayne C. Jaeschke; Norvell E. Wisdom, Jr.; Beatrice N. Robbins

[57] ABSTRACT

A highly corrosion-resistant, highly alkali-resistant, and very paintable chromate film on the surface of a steel substrate coated with Zn-containing metal is formed by coating the substrate with an aqueous chromate bath and drying into place, preferably at a substrate temperature of 60° to 200° C., without a water rinse. The bath contains $Cr^{6+}$, $Cr^{3+}$, phosphate ions, water-soluble glycol ether (WSGE) and/or poly{vinyl alcohol} (PVA), and optionally silica sol, in amounts giving ratios of $Cr^{3+}/Cr^{6+}$=0.25 to 4.0, $PO_4$/total Cr=0.1 to 2.5, and (WSGE+PVA)/$Cr^{6+}$= 0.1 to 0.5 in the bath.

14 Claims, No Drawings

PROCESS FOR FORMING A SPARINGLY SOLUBLE CHROMATE COATING ON ZINCIFEROUS METAL COATED STEEL

BACKGROUND OF THE INVENTION

1. Field of the Invention

The invention relates to a treatment process that forms a sparingly soluble chromate coating on steel, especially steel sheet, coated with zinciferous metal. More specifically, the invention relates to a treatment process that produces a sparingly soluble chromate coating or film which exhibits an excellent corrosion resistance, alkali resistance, water resistance, paintability (paint film adherence and post-paint corrosion resistance), and in particular an excellent coatability with water-based paints. The treatment process of the invention forms these films on the surface of, for example, electrogalvanized steel, steel electroplated with zinc alloy, hot-dip galvanized steel, and steel hot-dip coated with zinc alloy (hereinafter collectively referred to as zinciferous metal-plated steel).

2. Statement of Related Art

Older chromate treatment technologies used aqueous solutions of chromic acid or dichromic acid in order to improve the corrosion resistance and paintability of zinciferous metal-plated steel sheet. Various types of chromate treatment processes and chromate film-forming processes have been proposed more recently in order to obtain ever greater levels of corrosion resistance and paintability. The essential features, advantages, and disadvantages of the various elements of this prior art are considered below.

Japanese Patent Publication Number Sho 52-2851 [2,851/1977] discloses a process for improving rust inhibition through the formation of a chromate film on the surface of zinciferous metal-plated steel sheet. This particular process is a film-forming process that uses an aqueous solution of chromic acid, silica sol, and a small quantity of trivalent chromium ions. However, since hexavalent chromium is the main component in the chromate film laid down by this process, the film is hygroscopic and exhibits an inadequate rust-inhibiting activity.

The process taught in Japanese Patent Publication Number Sho 61-58552 [58, 552/1986] uses a chromate bath of silica sol-chromic acid-reduced chromic acid. However, when a surface-treated steel sheet carrying chromate film formed by this process is subjected to additional processing and then painted, the hexavalent chromium ions are easily eluted from the chromate film during the alkaline cleaning step that precedes painting. This results in a reduced corrosion resistance by the film.

The processes taught in Japanese Patent Application Laid Open Numbers Sho 58-22383 [22,383/1983] and Sho 62-83478 [83,478/1987] use silane coupling agent to chemically reduce hexavalent chromium ions in the chromate treatment bath. The films produced by these processes exhibit an excellent adherence to paint films. However, the chromate film generated by the former process exhibits a poor alkali resistance because the chromate treatment bath used in this process lacks phosphoric acid. The chromate film generated by the latter process suffers from an inadequate alkali resistance for the same reason.

Japanese Patent Application Laid Open Number Sho 63-96275 [96,275/1988] discloses a treatment process that uses a chromate treatment bath containing a specific type of organic resin (the hydroxyl group has been introduced in a particular quantity into the resin molecule). However, because the chromate film laid down by this process contains carboxyl-bearing organic resin as produced by chromic acid oxidation, this film again has an unsatisfactory alkali resistance. Another drawback to this process is the very low stability of its treatment bath, which occurs because the reaction between chromic acid and the hydroxyl-bearing organic resin proceeds even in the solution.

Chromating technology must now also take into consideration the various measures that have come into play in the last few years accompanying the increasing levels of human consciousness with respect to global environmental protection. These measures differ from previous pollution control efforts in that the various regulations required for global environmental protection are now being implemented on a world-wide scale. For example, regulations are under consideration that would halt the production of chlorinated solvents or would lead to a comprehensive reduction in the discharge of carbon dioxide and volatile organic compounds. In order to achieve reductions in the use of organic solvents, industry is therefore switching from solvent-based paints to water-based paints and from chlorinated solvent degreasing to water-based degreasers.

The use of water-based degreasers and water-based paints imposes novel performance requirements on chromate film-forming treatments for zinciferous metal-plated steel that are not imposed by the older technologies of solvent-based painting and chlorinated solvent degreasing.

Resistance to dissolution in water-based paints is one example of a new performance property required of the films produced by the chromate treatment of zinciferous metal-plated steel. When the chromate film is highly soluble in water-based paint, components of the chromate film will dissolve into the water-based paint and the resin portion in the paint will gel. This impairs the appearance of the paint, and the deterioration in the resin reduces the performance of the paint film. Moreover, a high resistance to water-based alkaline degreasers is required, and thus alkali resistance also becomes a necessity.

When a poorly alkali-resistant chromate coating is produced, the chromium ions will elute into the degreaser, and the direct discharge of degreaser effluent will then create a new source of environmental pollution. This necessitates treatment to remove the chromium ions present in alkaline degreaser effluent.

However, a chromate film that solves all these problems has yet to appear.

DESCRIPTION OF THE INVENTION

Objects of the Invention

The invention seeks to solve the problems described above. In specific terms, the invention introduces a process that produces a sparingly soluble chromate coating or film on the surface of zinciferous metal-plated steel. The quality characteristics of this film (corrosion resistance, water resistance, paintability) exceed the previously required characteristics, and it has an improved alkali resistance and resistance to dissolution. In addition, the film produced by the invention has a particularly good paintability by water-based paints.

General Principles of Description

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred. Also, unless expressly stated to the contrary: percent, "parts" of, and ratio values are by weight; the term "polymer" includes "oligomer", "copolymer", "terpolymer", and the like; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description, and does not necessarily preclude chemical interactions among the constituents of a mixture once mixed; specification of materials in ionic form implies the presence of sufficient counterions to produce electrical neutrality for the composition as a whole (any counterions thus implicitly specified should preferably be selected from among other constituents explicitly specified in ionic form, to the extent possible; otherwise such counterions may be freely selected, except for avoiding counterions that act adversely to the objects of the invention); and the term "mole" and its variations may be applied to elemental, ionic, and any other chemical species defined by number and type of atoms present, as well as to compounds with well defined molecules.

SUMMARY OF THE INVENTION

The inventors discovered a treatment process that can coat the surface of zinciferous metal-plated steel with a tight film that is believed to contain a bond network formed from oxo and ol bonds. The inventors found that this could be done through the use of a water-based chromate liquid composition, usually called a "bath" hereinafter for brevity, that contains particular quantities of hexavalent chromium ion, trivalent chromium ions, phosphate ions, and a hydroxylic compound selected from water-soluble glycol ethers (hereinafter usually abbreviated "WSGE") and poly{vinyl alcohol} (hereinafter usually abbreviated "PVA") and present in a specific weight ratio relative to the hexavalent chromium ions, forming a liquid coating layer, preferably one substantially uniform in thickness, to give a coating weight of 5 to 200 mg/m$^2$ as chromium add-on on the metal substrate being treated, and then heating and drying the non-volatile contents of the liquid coating layer into place on the surface of the substrate being treated, without any intervening water rinse. The chromate film thereby produced exhibits an excellent corrosion resistance, alkali resistance, water resistance, processability, and paintability as well as a particularly good paintability by water-based paints.

It is believed that, during drying of the coated water-based chromate bath layer, the water-soluble glycol ether and/or PVA are oxidatively degraded by the chromic acid, and the hexavalent chromium ions are thereby simultaneously reduced. This would lead to the production of new trivalent chromium ions, and these nascent trivalent chromium ions and the trivalent chromium ions which were already present in the chromate bath could help to form the tight film noted above. (As reported in *Hyomen Gijutsu,* Volume 43, pp. 211–215 (1992) and elsewhere, the hexavalent chromium ions in dry-in-place chromate coatings are thought to be captured within a system of oxo and ol bonds formed during the drying step mainly by the trivalent chromium ions. This functions to insolubilize and immobilize the hexavalent chromium ions within the film.)

In specific terms, the invention comprises a treatment process for the formation of a sparingly soluble chromate coating on the surface of steel plated with zinc-containing metal, wherein said process characteristically comprises the application of a water-based chromate bath to the surface of steel plated with zinciferous metal (zinc or zinc-containing metal) to a coating weight of 5 to 200 mg/m$^2$ as chromium add-on, followed without a water rinse by drying of the coated bath layer, preferably at a metal substrate temperature of 60° C. to 200° C., wherein said water-based chromate bath comprises, preferably consists essentially of, or more preferably consists of water and: 1.0 to 40.0 grams per liter (hereinafter usually abbreviated as "g/L") of hexavalent chromium ions, 1.0 to 40.0 g/L of trivalent chromium ions, 0.4 to 100 g/L of phosphate ions, and at least one selection from the group consisting of WSGE and PVA, and has a (trivalent chromium ions)/(hexavalent chromium ions) ratio of 0.25 to 4.0, a (phosphate ions)/(total chromium ions) weight ratio of 0.1 to 2.5, and a (water-soluble glycol ether+PVA)/(hexavalent chromium ions) ratio of 0.1 to 0.5. The water-based chromate bath used by the invention process preferably also contains silica sol at a weight ratio of silica sol solids to total chromium ions of 0.1 to 6.0.

DESCRIPTION OF PREFERRED EMBODIMENTS

The composition of the water-based chromate bath used by the invention process will be considered in detail first. This chromate bath uses water as its solvent, and it contains 1.0 to 40.0, or preferably 2.0 to 25, g/L of hexavalent chromium ions and 1.0 to 40.0, or preferably 2.0 to 15, g/L of trivalent chromium ions as its basic components. The formation of a chromate film with a satisfactory corrosion resistance is highly problematic at a hexavalent chromium ions concentration or trivalent chromium ions concentration below 1.0 g/L. A hexavalent chromium ions concentration or trivalent chromium ions concentration in excess of 40.0 g/L causes the viscosity of the water-based chromate bath to increase and its stability to decline, and these phenomena make it extremely difficult to control the chromium add-on to the desired value.

The ratio between the trivalent chromium ions and hexavalent chromium ions is an important parameter for the water-based chromate bath of the invention, and the trivalent chromium ions/hexavalent chromium ions weight ratio must be in the range of 0.25 to 4.0, or preferably is from 0.25 to 3.0. The hexavalent chromium ions concentration in the aqueous bath becomes too high when this ratio is below 0.25. Such ratios result in a deterioration in the quality of the water-based chromate bath upon addition of the WSGE and/or PVA, because reduction of the hexavalent chromium ions in the bath by these hydroxylic compounds readily proceeds to excess under these conditions. When this ratio exceeds 4.0, the water-based chromate bath has a strong tendency to gel and the chromate film also exhibits a reduced corrosion resistance. The (trivalent chromium ions)/(hexavalent chromium ions) ratio can be adjusted as desired by the addition of known reducing agents, such as ethanol, methanol, oxalic acid, starch, or sucrose.

Another component in the water-based chromate bath of the invention is phosphate ions, which should be present at 0.4 to 100, or preferably 7.5 to 50, g/L. The stoichiometric equivalent as $PO_4^{-3}$ of any inorganic phosphorus-containing acid, anionic ionization product thereof, or salt thereof present in the bath is to be understood as part of the phosphate ions content of the bath for purposes of this description. Orthophosphoric acid ($H_3PO_4$) is the preferred source of the phosphate ions. The corrosion resistance and alkali resistance of the chromate film decline when the phosphate ions concentration is below 0.4 g/L. At phosphate ions concentrations in excess of 100 g/L, the water solubility of the chromate film increases to such a degree that the resistance to dissolution in water-based paint usually will no longer be satisfactory, and as a result the post-painting appearance and the paint film performance will be sharply reduced.

Adjustment of the (phosphate ions)/(trivalent chromium ions+ hexavalent chromium ions) ratio in the water-based chromate bath into a specific range is of particular importance for the phosphate ions content. The (phosphate ions)/(total chromium ions) ratio should be adjusted into the range of 0.1 to 2.5. A ratio below 0.1 gives a chromate film with an increasingly diminished alkali resistance and corrosion resistance. The acidity of the water-based chromate bath is too high when this ratio exceeds 2.5, and the reduction of hexavalent chromium ions in the bath by the water-soluble glycol ether and/or PVA will therefore readily proceed to excess. As a consequence, the quality of the water-based chromate bath is impaired because a major fraction of the hexavalent chromium ions in the water-based chromate bath will be reduced to trivalent chromium ions prior to application.

The (WSGE and/or PVA)/(hexavalent chromium ions) weight ratio in the water-based chromate bath should be 0.1 to 0.5 in the present invention. When this hexavalent chromium ions-based weight ratio falls below 0.1, it is believed that too few new trivalent chromium ions are produced by reduction. This would impair the formation of a chromate film that has an excellent corrosion resistance, alkali resistance, water resistance, processability, and paintability, in particular an excellent paintability by water-based paint. When this hexavalent chromium ions-based weight ratio exceeds 0.5, the chromate film will usually have a poor water resistance, presumably because WSGE and/or PVA that has escaped oxidative degradation will be present in the chromate film.

While there are no narrow restrictions on WSGE usable by the present invention, these compounds preferably conform to one of the following general formulas:

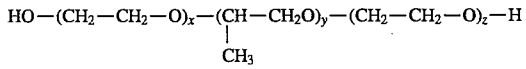

and

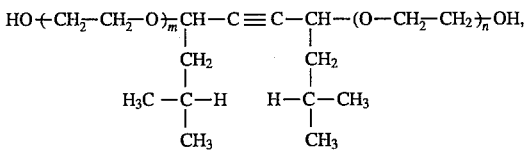

where [y/(x+z)]=0 to 5, x+z≧1, the values of x, y and z are selected so that the average molecular weight of the formula in which these letters occur=62 to 20,000, and (m+n)=0 to 30.

No narrow restrictions apply to PVA's usable by the present invention, and those PVA's generally and widely available commercially can be used. Specific preferred examples in this regard are selections from the partial and complete saponification products of polyvinyl acetate.

The water-based chromate bath preferably also contains silica sol. The silica sol is believed to act mainly to improve the corrosion resistance of the chromate film and to improve its paint adherence and scratch resistance. For these purposes the silica sol content preferably is such as to give a (silica sol solids)/(total chromium ions) ratio of 0.1 to 6.0. The effect from silica sol addition is usually inadequate at values for this ratio below 0.1. When the value of this ratio exceeds 6.0, the secondary adherence of the paint film after exposure to water will usually be inadequate.

While no narrow restrictions apply to silica sol usable by the present invention, the silica sol is most suitably selected from, inter alia, wet-process colloidal silicas, for example, as prepared by the ions exchange of water glass; dry-process fumed silicas, for example, as prepared by the hydrolysis of silicon tetrachloride in air; and microparticulate silica sols, for example, as prepared by grinding.

The water-based chromate bath formulated as described above may be coated on the surface of zinciferous metal-plated steel by roll coating, spray, immersion, or other suitable methods. The chromate film add-on is preferably 5 to 200, or more preferably 13 to 200, mg/m$^2$ as chromium metal. A deposition of less than 5 mg/m$^2$ as chromium metal usually gives an inadequately performing chromate film. Depositions in excess of 200 mg/m$^2$ are economically undesirable because no additional increases in performance are usually afforded by such high amounts of deposition.

A high-performance chromate film is then formed according to the invention process by heating and drying the water-based chromate bath layer on the zinciferous metal-plated steel without an intervening water rinse. The drying temperature is preferably a temperature that yields a zinciferous metal-plated steel temperature of 60° C. to 200° C. The reaction between hexavalent chromium ions and the WSGE and/or PVA is slow when the sheet temperature is below 60° C.; this impairs the productivity. On the other hand, no additional benefits are usually obtained at temperatures in excess of 200° C., and the corresponding waste of thermal energy makes such temperatures economically undesirable.

Metal ions originating from the plating components, such as zinc ions, aluminum ions, nickel ions, iron ions, and the like, unavoidably enter the water-based chromate bath from the surface of the zinciferous metal-plated steel substrate during application of the water-based chromate bath in the process of the invention. However, fluctuations in the composition of the water-based chromate bath can be controlled by inhibiting the elution of these metal ions through their preliminary addition to the bath.

The invention will be illustrated in detail through the following working examples; however, the scope of the invention is not limited by these examples.

Examples 1 to 16 and Comparative Examples 1 to 8

The following procedures and tests were carried out in Examples 1 to 16 and Comparative Examples 1 to 8.

1. Preparation of water-based chromate baths A to H (baths according to the invention) and water-based chromate baths I to M (comparative baths)

Water-based chromate bath (A) was prepared as follows: An amount of 200 grams (hereinafter usually abbreviated "g") of chromic anhydride (i.e., $CrO_3$) was first dissolved in 500 g of water, and 86 g of a 75% aqueous solution of phosphoric acid and 18 g of methanol were added to the resulting aqueous solution. Heating for 1 hour at 80° C. to 90° C. gave reduction to a trivalent chromium ions/hexavalent chromium ions weight ratio of 1.0. After cooling, the solution was brought to a total of 1 kg with water. The resulting aqueous solution was diluted with water to give a total chromium ions concentration of 40 grams per liter (hereinafter usually abbreviated as "g/L"), followed by the addition of 20 g/L of Aerosil™ #200 silica sol (commercially available from Nihon Aerosil) and 9 g/L of Gosenol™ NL-05 (commercially available from Nihon Gosei Kagaku Kogyo) PVA. The product was designated water-based chromate bath A. Water-based chromate baths B to K were prepared by the same procedure used for water-based chromate bath A, but with variations in the types and/or amounts of ingredients added, as shown in detail below in Table 1. The same commercial PVA as in bath A was used where PVA is shown in Table 1, and Newpol™ PE-61 (commercially available from Sanyo Kasei Kogyo) was used as the WSGE shown in Table 1.

TABLE 1

COMPOSITION AND STABILITY OF THE CHROMATE TREATMENT BATHS

| Bath | g/L of $Cr^{+6}$ | g/L of $Cr^{+3}$ | g/L of $PO_4^{-3}$ | $Cr^{+3}/Cr^{+6}$ Ratio | $PO_4^{-3}$/ Total Cr Ratio | g/L of $SiO_2$ | $SiO_2$/ Total Cr ratio | g/L of WSGE | g/L of PVA | Total (WSGE + PVA)/ $Cr^{-6}$ Ratio | Stability Rating |
|---|---|---|---|---|---|---|---|---|---|---|---|
| A | 25.0 | 15.0 | 16.0 | 0.60 | 0.10 | 10.0 | 0.25 | 0 | 2.5 | 0.10 | ++ |
| B | 6.0 | 9.0 | 14.0 | 1.50 | 0.93 | 30.0 | 2.00 | 3.0 | 0 | 0.50 | ++ |
| C | 3.0 | 2.0 | 7.5 | 0.67 | 1.50 | 30.0 | 6.00 | 1.0 | 0 | 0.33 | ++ |
| D | 2.0 | 8.0 | 20.0 | 4.00 | 2.00 | 20.0 | 2.00 | 0 | 0.4 | 0.20 | ++ |
| E | 40.0 | 40.0 | 40.0 | 1.00 | 0.50 | 0 | 0 | 0 | 4.0 | 0.10 | ++ |
| F | 10.0 | 2.5 | 22.5 | 0.25 | 1.80 | 1.3 | 0.10 | 1.0 | 1.0 | 0.20 | ++ |
| G | 1.0 | 1.0 | 0.4 | 1.00 | 0.40 | 6.0 | 3.00 | 0 | 0.1 | 0.10 | ++ |
| H | 5.0 | 15.0 | 50.0 | 3.00 | 2.50 | 40.0 | 2.00 | 1.2 | 0 | 0.24 | ++ |
| I | 20.0 | 15.0 | 0 | 0.75 | 0 | 0 | 0 | 0 | 0 | 0 | ++ |
| J | 10.0 | 15.0 | 20.0 | 1.50 | 0.80 | 15.0 | 1.00 | 0 | 0 | 0 | ++ |
| K | 15.0 | 2.5 | 1.0 | 0.17 | 0.06 | 35.0 | 2.0 | 8.0 | 4.0 | 0.80 | x |
| L | 15.0 | 15.0 | 18.0 | 1.00 | 1.20 | 30.0 | 1.0 | 0 | 1.0 | 0.07 | ++ |
| M | 1.5 | 10.5 | 36.0 | 7.00 | 3.0 | 6.0 | 0.5 | 0.6 | 0 | 0.40 | + |

Note for Table 1
Baths A–H are according to the invention, while baths I–M are not according to the invention and are used in Comparison Examples only.

2. The chromate treatment procedure

Chromate films were prepared using the process given below by application of a water-based chromate bath prepared as described above to the surface of electrogalvanized steel sheets (plated on both sides to give an add-on of 20 grams per square meter, hereinafter often abbreviated as "$g/m^2$) and sheets of steel that had been electroplated with zinc/nickel alloy (plated on both sides to give an add-on=20 $g/m^2$, nickel content of the plating=11%). Oiled substrate sheets were used in all cases. Application of coating was followed by drying of the applied bath layer without a water rinse.

The treatment process steps and sequence were as follows:

Alkaline degreasing
↓
Water rinse
↓
Roll wipe
↓
Drying (convection)
↓
Chromate application
↓
Alkaline degreasing (optional)
↓
Drying Alkaline degreasing was done by spraying a 2% aqueous solution of a commercial weakly alkaline degreaser (Palklin™ 342 from Nihon Parkerizing Company, Limited) at 60° C. onto the substrate sheets for 30 seconds. Drying was for 7 seconds at a sheet temperature of 150° C.

3. Preparation of painted sheets

After drying, the chromated steel sheet was painted with the white acrylic/styrene emulsion paint described below, then dried and baked for 20 minutes at 140° C. to give a painted sheet with a paint thickness=40 micrometers. The water-based paint recipe was:

| Components | Parts |
|---|---|
| Maincote ™ HG54 acrylic/styrene emulsion (40% solids, commercially available from Rohm and Haas Company) | 632.6 |
| Orotan ™ 165 dispersant (supplied by Rohm and Haas) | 8.4 |
| Triton ™ CF-10 wetting agent (supplied by Rohm and Haas) | 2.0 |
| Nopco ™ DF-122-NS antifoam agent (from Sun Nopco Co.) | 3.5 |
| Primal ™ RM-1020 rheology improver (supplied by Rohm and Haas) | 22.0 |
| Deionized water | 44.1 |
| 28% ammonia solution inwater | 5.0 |
| Texanol ™ glycol ether solvent | 39.4 |
| Methyl carbitol | 59.0 |
| Tipake ™ R-830 titanium oxide (supplied by Ishihara Sangyo Company) | 195.0 |
| Total parts | 1011.0 |

4. Performance evaluation testing 4.1 Stability testing of the water-based chromate baths Each of the water-based chromate baths A to K was held in a thermostatted storage space at 50° C. for 24 hours, after which the appearance of the bath was visually rated according to the following scale:

| | |
|---|---|
| ++ | no change |
| + | a definite increase in viscosity was observed |
| x | gelation |

4.2 Alkali resistance test

The chromated steel sheets were subjected to water-based alkaline degreasing by spraying a 2% aqueous solution of a commercial sodium silicate-based alkaline degreaser (Palklin™ N364S from Nihon Parkerizing Company, Limited) for 2 minutes at 60° C., and the chromium deposition in mg/m$^2$ was measured by an x-ray fluorescence analysis method both before and after degreasing. The alkali resistance (%) was then calculated from the measured values using the equation:

$$\text{alkali resistance (\%)} = \left(1 - \frac{\text{chromium deposition after the alkaline rinse}}{\text{chromium deposition before the alkaline rinse}}\right) \times 100.$$

A better alkali resistance (usually abbreviated hereinafter as "AR") is indicated by lower calculated % values, and a value of zero indicates that alkali had no effect on the chromate film in this test.

4.3 Boiling water resistance

The chromated steel sheet was immersed in boiling deionized water for 10 minutes, and the chromium deposition in mg/m$^2$ was measured by an x-ray fluorescence analysis method both before and after immersion. The boiling water resistance (hereinafter usually abbreviated as "BWR") in % was then calculated from the measured values using the equation:

$$BWR\ (\%) = \left(1 - \frac{\text{chromium deposition after immersion in boiling water}}{\text{chromium deposition before immersion in boiling water}}\right) \times 100.$$

A better BWR is indicated by lower % values, and a value of zero indicates that boiling water had no effect on the chromate film in this test.

4.4 Corrosion resistance (1) Corrosion resistance of the electrogalvanized steel sheet Rectangular test panels 70 mm×150 mm, both with and without alkaline degreasing, were subjected to salt spray testing according to Japanese Industrial Standard (hereinafter usually abbreviated "JIS") Z-2371 for 150 hours. The corrosion resistance was then evaluated, based on white rust development over the entire area of the test panel, and reported on the following scale:

| | |
|---|---|
| +++ | 0% area of white rust development |
| ++ | white rust area, but less than 10% |
| + | white rust area is at least 10%, but less than 30% |
| x | white rust area is at least 30% |

(2) Corrosion resistance of the Zn/Ni-electroplated steel sheet

Test panels, both with and without alkaline degreasing, were subjected to 50 cycles of comprehensive corrosion testing. One cycle in this test consisted of 4 hours of salt spray, drying for 2 hours at 60° C., and exposure for 2 hours to air at 50° C. with a relative humidity≧95%. The corrosion resistance was then evaluated, based on red rust development over the entire area of the test panel, and reported on the following scale:

| | |
|---|---|
| +++ | 0% area of red rust development |
| ++ | red rust area, but less than 10% |
| + | red rust area is at least 10%, but less than 30% |
| x | red rust area is at least 30%. |

4.5 Corrosion resistance of the painted sheets

By using a cutter, a cut was scribed in the paint film down to the substrate metal, and the test panel was then subjected to salt spray testing (200 hours for the electrogalvanized steel sheet, 300 hours for the Zn/Ni-electroplated steel sheet). After the exposure to salt spray, the paint was peeled with pressure-sensitive cellophane tape. The evaluation consisted of measuring the maximum width in millimeters ("mm") of peeling from one side of the cut.

4.6 Appearance of the paint

Using the scale given below, the appearance of the paint was visually evaluated on a test panel that had been painted without an alkaline rinse.

| | |
|---|---|
| ++ | no abnormalities in appearance |
| + | rough paint surface |
| x | very rough paint surface |

4.7 Paint film adherence (1) Checkerboard testing

Using a cutter, a grid of 1 mm-square cells was cut to reach the substrate metal on a test panel that had been painted without an alkaline rinse. Adhesive cellophane tape was applied to the surface of the test panel and then sharply pulled off, and the degree of paint peeling was thereafter evaluated. The paint adherence, both in this test and in the Erichsen extrusion test described below, was evaluated on the following four-level scale:

| | |
|---|---|
| +++ | 0% paint peeling |
| ++ | less than 10% paint peeling |
| + | at least 10%, but less than 30% paint peeling |
| x | at least 30% paint peeling |

(2) Erichsen extrusion test

Using an Erichsen extruder, a 6-mm extrusion was impressed into a test panel that had been painted without an alkaline rinse. Cellophane tape was then applied and sharply peeled off, and the degree of paint peeling was thereafter evaluated and reported on the scale given above.

The results from the preceding tests are reported in Tables 2– 4. In the second column from the left in all these tables, the entry "Zn" means that the steel sheet substrate treated was plated with substantially pure zinc, while "ZnNi" means that the plate was with zinc-nickel alloy as already described above.

As the results from Examples 1 through 16 in Tables 2–4 make clear, the execution of chromate treatment according to the present invention on zinciferous metal-plated steel sheet forms thereon a chromate film that exhibits an elevated corrosion resistance, alkali resistance, water resistance, paintability by aqueous paints, adherence by water-based paint films, and post-paint corrosion resistance. Moreover, the results reported in Table 1 show that the water-based chromate bath used by the invention process is very stable, which directly supports industrially advantageous properties such as a capability for continuous operations. While the methods practiced in Comparative Examples 1 to 8 were effective in regard to the simple corrosion resistance of the chromate film prior to a degreasing, they gave unsatisfactory results for the alkali resistance, water resistance, paintability with water-based paints, adherence by water-based paint films, and post-painting corrosion resistance.

As has been discussed above in detail, the process of the invention for chromating zinciferous metal-plated steel sheet produces a chromate film with a substantially improved corrosion resistance, alkali resistance, water resistance, paintability with water-based paints, adherence by water-based paint films, and post-paint corrosion resistance. Moreover, the treatment bath in the process of the invention is stable. As a result of these attributes, the process of the invention offers extremely important practical advantages.

TABLE 2

AMOUNTS OF CHROMIUM DEPOSITED AND ALKALI AND BOILING WATER RESISTANCE TEST RESULTS

| Example ("E") or Comparison Example ("CE") No. | Type of Zinciferous Metal Coated on Treated Substrate | Chromate Bath Identifying Letter (from Table 1) | $mg/m^2$ of Chromium Deposited on the Treated Substrate | Alkali Resistance Test % Value | Boiling Water Resistance Test % Value |
|---|---|---|---|---|---|
| E1 | Zn | A | 100 | 1.1 | 1.4 |
| E2 | " | B | 38 | 0 | 0.3 |
| E3 | " | C | 13 | 0 | 0 |
| E4 | " | D | 25 | 0 | 0.2 |
| E5 | " | E | 200 | 1.8 | 2.3 |
| E6 | " | F | 32 | 0 | 0.2 |
| E7 | " | G | 5 | 0 | 0 |
| E8 | " | H | 50 | 0 | 0.6 |
| E9 | ZnNi | A | 100 | 1.6 | 1.4 |
| E10 | " | B | 38 | 0 | 0.6 |
| E11 | " | C | 13 | 0 | 0 |
| E12 | " | D | 25 | 0 | 0 |
| E13 | " | E | 200 | 2.3 | 1.8 |
| E14 | " | F | 32 | 0 | 0 |
| E15 | " | G | 5 | 0 | 0 |
| E16 | " | H | 50 | 0.8 | 0 |
| CE1 | Zn | I | 88 | 65.1 | 78.2 |
| CE2 | " | J | 63 | 70.2 | 86.7 |
| CE3 | " | L | 75 | 55.2 | 63.8 |
| CE4 | " | M | 30 | 48.8 | 59.4 |
| CE5 | ZnNi | I | 88 | 67.3 | 88.6 |
| CE6 | " | J | 63 | 81.2 | 96.7 |
| CE7 | " | L | 75 | 64.3 | 73.6 |
| CE8 | " | M | 30 | 51.8 | 61.5 |

TABLE 3

CORROSION RESISTANCE TEST RESULTS

| Example ("E") or Comparison Example ("CE") No. | Type of Zinciferous Metal Coated on Treated Substrate | Chromate Bath Identifying Letter (from Table 1) | Corrosion Resistance: Unpainted, Before Degreasing | Unpainted, After Degreasing | Painted, Before Degreasing | Painted, After Degreasing |
|---|---|---|---|---|---|---|
| E1 | Zn | A | +++ | +++ | 1.2 | 1.2 |
| E2 | " | B | +++ | +++ | 2.2 | 2.0 |
| E3 | " | C | ++ | ++ | 2.6 | 2.4 |
| E4 | " | D | ++ | ++ | 2.4 | 2.6 |
| E5 | " | E | +++ | +++ | 0.6 | 0.8 |
| E6 | " | F | +++ | +++ | 1.8 | 1.8 |
| E7 | " | G | ++ | + | 2.4 | 2.6 |
| E8 | " | H | +++ | +++ | 1.8 | 1.8 |
| E9 | ZnNi | A | +++ | +++ | 0.6 | 0.8 |
| E10 | " | B | +++ | +++ | 2.0 | 2.2 |
| E11 | " | C | ++ | ++ | 2.0 | 1.8 |
| E12 | " | D | ++ | ++ | 1.6 | 1.8 |
| E13 | " | E | +++ | +++ | 0.6 | 0.6 |
| E14 | " | F | ++ | ++ | 1.4 | 1.6 |
| E15 | " | G | ++ | + | 2.4 | 2.6 |
| E16 | " | H | +++ | +++ | 1.0 | 1.2 |
| CE1 | Zn | I | ++ | x | 5.6 | 6.8 |
| CE2 | " | J | ++ | x | 6.8 | 7.2 |
| CE3 | " | L | +++ | x | 4.4 | 5.6 |
| CE4 | " | M | ++ | x | 4.6 | 5.0 |
| CE5 | ZnNi | I | ++ | x | 12.0 | 14.2 |
| CE6 | " | J | ++ | x | 10.2 | 12.6 |
| CE7 | " | L | +++ | x | 7.8 | 8.4 |
| CE8 | " | M | ++ | x | 7.6 | 8.8 |

TABLE 4

PAINT FILM PROPERTY TEST RESULTS

| Example ("E") or Comparison Example ("CE") No. | Type of Zinciferous Metal Coated on Treated Substrate | Chromate Bath Identifying Letter (from Table 1) | Physical Properties of the Paint Films: Appearance | Adherence Test: Checkerboard | Adherence Test: Erichsen |
|---|---|---|---|---|---|
| E1 | Zn | A | +++ | +++ | +++ |
| E2 | " | B | +++ | +++ | +++ |
| E3 | " | C | +++ | +++ | +++ |
| E4 | " | D | +++ | +++ | +++ |
| E5 | " | E | +++ | +++ | +++ |
| E6 | " | F | +++ | +++ | +++ |
| E7 | " | G | +++ | +++ | ++ |
| E8 | " | H | +++ | +++ | +++ |
| E9 | ZnNi | A | +++ | +++ | +++ |
| E10 | " | B | +++ | +++ | +++ |
| E11 | " | C | +++ | +++ | +++ |
| E12 | " | D | +++ | +++ | +++ |
| E13 | " | E | +++ | +++ | +++ |
| E14 | " | F | +++ | +++ | +++ |
| E15 | " | G | +++ | +++ | ++ |
| E16 | " | H | +++ | +++ | +++ |
| CE1 | Zn | I | + | x | x |
| CE2 | " | J | x | + | x |
| CE3 | " | L | + | + | x |
| CE4 | " | M | + | x | x |
| CE5 | ZnNi | I | x | x | x |
| CE6 | " | J | x | + | x |

TABLE 4-continued

| PAINT FILM PROPERTY TEST RESULTS | | | | | |
|---|---|---|---|---|---|
| Example ("E") or Comparison | Type of Zinciferous Metal Coated on | Chromate Bath | Physical Properties of the Paint Films | | |
| Example | Treated | Identifying Letter | | Adherence Test: | |
| ("CE") No. | Substrate | (from Table 1) | Appearance | Checkerboard | Erichsen |
| CE7 | " | L | + | + | x |
| CE8 | " | M | + | x | x |

The invention claimed is:

1. A process for the formation of a solid sparingly soluble chromate coating on the outer surface of a steel substrate coated with zinc-containing metal, said process comprising steps (I) covering the outer surface of the substrate with a layer of an aqueous liquid treatment composition consisting essentially of:

(A) an aqueous mixture, said aqueous mixture containing (I.A) 1.0 to 40.0 g/L of hexavalent chromium (I.B) 1.0 to 40.0 g/L of trivalent chromium ions; and (I.C) 0.4 to 100 g/L of phosphate ions, the concentration of hexavalent chromium ions, and trivalent chromium ions and phosphate ions being selected so as to result in a (trivalent chromium ions)/(hexavalent chromium ions) ratio of 0.25 to 4.0 in said aqueous mixture and a (phosphate ions/total chromium ions) ratio of 0.1 to 2.5 in said aqueous mixture, admixed with (B) a component (I.D) selected from the group consisting of poly{vinyl alcohols} ("PVA") and water-soluble glycol ethers ("WSGE") having an average molecular weight of 62 to 20,000 in an amount such as to result in a (WSGE+PVA)/(hexa-valent chromium ions) weight ratio of 0.1 to 0.5 in said aqueous liquid treatment composition, wherein the thickness of the layer of the aqueous liquid treatment composition covering the outer surface of the substrate is such as to contain from 5 to 200 mg/m$^2$ of chromium, and (II) drying into place on the treated surface of the substrate the liquid layer formed on the treated surface in step (I), without any intermediate rinsing, whereby the solid sparingly soluble chromate coating is formed and incorporates the nonvolatile contents of the liquid layer formed on the treated surface in step (I).

2. A process according to claim 1, wherein in step (II) the metal substrate is heated to a maximum temperature in the range from 60° C. to 200° C.

3. A process according to claim 2, wherein the aqueous liquid treatment composition also contains silica sol in an amount that results in a (silica sol)/(total chromium ions) ratio of 0.1 to 6.0 in the aqueous liquid treatment composition.

4. A process according to claim 1, wherein the aqueous liquid treatment composition also contains silica sol in an amount that results in a (silica sol)/(total chromium ions) ratio of 0.1 to 6.0 in the aqueous liquid treatment composition.

5. A process according to claim 1, wherein any WSGE in the aqueous liquid treatment composition is selected from molecules that conform to one of the general formulas:

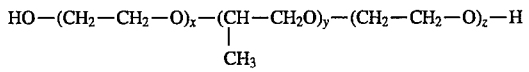

and

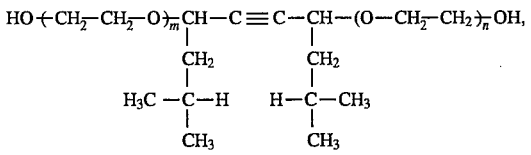

where [y/(x+z)]=0 to 5, x+z≧1, the values of x, y and z are selected so that the average molecular weight of the formula in which these letters occur=62 to 20,000, and (m+n)=0 to 30.

6. A process according to claim 2 wherein any WSGE in the aqueous liquid treatment composition is selected from molecules that conform to one of the general formulas:

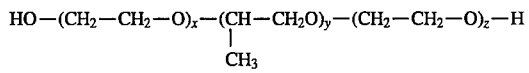

and

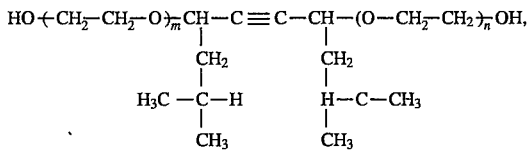

where [y/(x+z)]=0 to 5, x+z≧1, the values of x, y and z are selected so that the average molecular weight of the formula in which these letters occur=62 to 20,000, and (m+n)=0 to 30.

7. A process according to claim 3, wherein any WSGE in the aqueous liquid treatment composition is selected from molecules that conform to one of the general formulas:

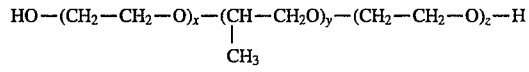

and

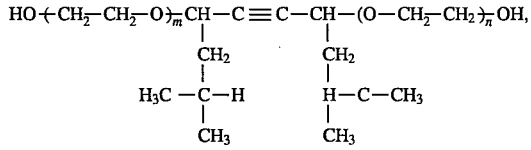

where [y/(x+z)]=0 to 5, x+z≧1, the values of x, y and z are selected so that the average molecular weight of the formula in which these letters occur=62 to 20,000, and (m+n)=0 to 30.

8. A process according to claim 4, wherein any WSGE in the aqueous liquid treatment composition is selected from molecules that conform to one of the general formulas:

$$HO-(CH_2-CH_2-O)_x-(\underset{\underset{CH_3}{|}}{CH}-CH_2O)_y-(CH_2-CH_2-O)_z-H$$

and $$HO\left(CH_2-CH_2-O\right)_m\underset{\underset{H_3C-\underset{\underset{CH_3}{|}}{C}-H}{\underset{\underset{CH_2}{|}}{|}}}{CH}-C\equiv C-\underset{\underset{H-\underset{\underset{CH_3}{|}}{C}-CH_3}{\underset{\underset{CH_2}{|}}{|}}}{CH}-\left(O-CH_2-CH_2\right)_n OH,$$

where [y/(x+z)]=0 to 5, x+z≧1, the values of x, y and z are selected so that the average molecular weight of the formula in which these letters occur=62 to 20,000, and (m+n)=0 to 30.

9. An aqueous liquid composition of matter suitable for treating the surface of a zinc-containing metal coated steel substrate to form a solid sparingly soluble chromate containing protective coating thereon after drying into place, wherein said aqueous liquid composition is an admixture of (A) an aqueous solution of hexachromium ions, trivalent chromium ions, and phosphate ions and (B) an amount of a component selected from the group consisting of poly{vinyl alcohols} ("PVA") and water soluble glycol ethers ("WSGE"), wherein said aqueous solution consists essentially of water and:

1.0 to 40.0 g/L of hexavalent chromium ions;

1.0 to 40.0 g/L o trivalent chromium ions; and 0.4 to 100 g/L of phosphate ions, wherein component (B) is selected from the group consisting of poly{vinyl alcohols} ("PVA") and water-soluble glycol ethers ("WSGE") having an average molecular weight of 62 to 20,000, in an amount of component (B) such as to result in a (WSGE+ PVA)/(hexavalent chromium ions) weight ratio of 0.1 to 0.5 in said aqueous liquid composition, and wherein the concentrations of hexavalent chromium ions, trivalent chromium ions and phosphate ions in said aqueous solution result in a (trivalent chromium ions)/(hexavalent chromium ions) ratio of 0.25 to 4.0 in said aqueous solution and a (phosphate ions)/(total chromium ions) ratio of 0.1 to 2.5 in said aqueous solution.

10. A composition according to claim 9, consisting essentially of water and:

(A) 1.0 to 40.0 g/L of hexavalent chromium ions;

(B) 1.0 to 40.0 g/L of trivalent chromium ions;

(C) 0.4 to 100 g/L of phosphate ions; and (D) a component selected from the group consisting of PVA and WSGE in an amount such as to result in a (WSGE+PVA)/(hexavalent chromium ions) weight ratio of 0.1 to 0.5 in said aqueous liquid composition; and, optionally, (E) silica sol in an amount that results in a (silica sol)/(total chromium ions) ratio of 0.1 to 6.0 in the aqueous liquid treatment composition.

11. A composition according to claim 10, wherein the concentration of hexavalent chromium ions is from about 20 to about 25 g/L, the concentration of trivalent chromium ions is from about 2.0 to 15 g/L, and the concentration of phosphate ions is from about 7.5 to about 50 g/L, and the (trivalent chromium ions)/(hexavalent chromium ions) ratio is from about 0.25 to about 3.0.

12. A composition according to claim 9, wherein any WSGE in the aqueous liquid treatment composition is selected from molecules that conform to one of the general formulas:

$$HO-(CH_2-CH_2-O)_x-(\underset{\underset{CH_3}{|}}{CH}-CH_2O)_y-(CH_2-CH_2-O)_z-H$$

and $$HO\left(CH_2-CH_2-O\right)_m\underset{\underset{H_3C-\underset{\underset{CH_3}{|}}{C}-H}{\underset{\underset{CH_2}{|}}{|}}}{CH}-C\equiv C-\underset{\underset{H-\underset{\underset{CH_3}{|}}{C}-CH_3}{\underset{\underset{CH_2}{|}}{|}}}{CH}-\left(O-CH_2-CH_2\right)_n OH,$$

where [y/(x+z)]=0 to 5, x+z≧1, the values of x, y and z are selected so that the average molecular weight of the formula in which these letters occur=62 to 20,000, and (m+n)=0 to 30.

13. A composition according to claim 10, wherein any WSGE in the aqueous liquid treatment composition is selected from molecules that conform to one of the general formulas:

$$HO-(CH_2-CH_2-O)_x-(\underset{\underset{CH_3}{|}}{CH}-CH_2O)_y-(CH_2-CH_2-O)_z-H$$

and $$HO\left(CH_2-CH_2-O\right)_m\underset{\underset{H_3C-\underset{\underset{CH_3}{|}}{C}-H}{\underset{\underset{CH_2}{|}}{|}}}{CH}-C\equiv C-\underset{\underset{H-\underset{\underset{CH_3}{|}}{C}-CH_3}{\underset{\underset{CH_2}{|}}{|}}}{CH}-\left(O-CH_2-CH_2\right)_n OH,$$

where [y/(x+z)]=0 to 5, x+z≧1, the values of x, y and z are selected so that the average molecular weight of the formula in which these letters occur=62 to 20,000, and (m+n)=0 to 30.

14. A composition according to claim 11, wherein any WSGE in the aqueous liquid treatment composition is selected from molecules that conform to one of the general formulas:

$$HO-(CH_2-CH_2-O)_x-(\underset{\underset{CH_3}{|}}{CH}-CH_2O)_y-(CH_2-CH_2-O)_z-H$$

and $$HO\left(CH_2-CH_2-O\right)_m\underset{\underset{H_3C-\underset{\underset{CH_3}{|}}{C}-H}{\underset{\underset{CH_2}{|}}{|}}}{CH}-C\equiv C-\underset{\underset{H-\underset{\underset{CH_3}{|}}{C}-CH_3}{\underset{\underset{CH_2}{|}}{|}}}{CH}-\left(O-CH_2-CH_2\right)_n OH,$$

where [y/(x+z)]=0 to 5, x+z≧1, the values of x, y and z are selected so that the average molecular weight of the formula in which these letters occur=62 to 20,000, and (m+n)=0 to 30.

* * * * *

UNITED STATES PATENT AND TRADEMARK OFFICE

CERTIFICATE OF CORRECTION

PATENT NO. : 5,507,884

DATED : Apr. 16, 1996

INVENTOR(S) : Takao Ogino; Shinji Nomura

It is certified that error appears in the above-indentified patent and that said Letters Patent is hereby corrected as shown below:

In col. 9, Components table, after "28% ammonia solution", delete "inwater" and insert --in water--.

In col. 7, line 60, between ""g/m²" and ")", insert --"--.

In col. 17, line 33, delete "o" and insert --of--.

In col. 17, line 64, delete "20" and insert --2.0--.

Col. 16, 17, and 18

In claims 7,8,13, and 14, the second formula should read:

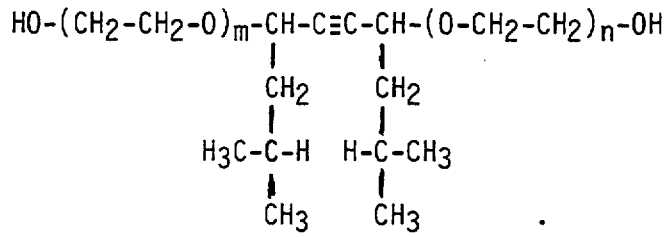

Signed and Sealed this

Twenty-seventh Day of August, 1996

*Attest:*

BRUCE LEHMAN

*Attesting Officer*

*Commissioner of Patents and Trademarks*